US006562198B2

(12) United States Patent
Beck et al.

(10) Patent No.: US 6,562,198 B2
(45) Date of Patent: May 13, 2003

(54) CROSS-DIRECTIONAL INTERLOCKING OF ROLLS IN AN AIR PRESS OF A PAPERMAKING MACHINE

(75) Inventors: David A. Beck, Appleton, WI (US); Thomas Gorshe, Neenah, WI (US)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/965,015

(22) Filed: Sep. 27, 2001

(65) Prior Publication Data

US 2003/0056921 A1 Mar. 27, 2003

(51) Int. Cl.[7] ..... D21F 3/00

(52) U.S. Cl. ..... 162/360.3; 162/358.1; 34/115; 34/634

(58) Field of Search ..... 162/205, 206, 162/358.1–358.5, 359.1, 360.2, 360.3, 361, 375; 100/47, 118, 155 R, 161, 162 R, 168–170, 176; 34/115, 119, 122, 124, 601, 242, 444, 452, 618, 620, 623, 629, 634, 646; 385/275; 277/300, 358, 361, 363, 366–369, 377, 386, 387, 409, 558, 581, 583

(56) References Cited

U.S. PATENT DOCUMENTS

| | | | | | |
|---|---|---|---|---|---|
| 3,293,121 | A | * | 12/1966 | Martin | 100/163 R |
| 3,315,370 | A | * | 4/1967 | Hikosaka | 100/118 |
| 3,808,096 | A | * | 4/1974 | Busker et al. | 100/118 |
| 4,124,942 | A | * | 11/1978 | Ohls et al. | 34/115 |
| 4,173,249 | A | * | 11/1979 | Holkko et al. | 100/118 |
| 4,675,079 | A | * | 6/1987 | Webster | 100/118 |

* cited by examiner

*Primary Examiner*—Steven P. Griffin
*Assistant Examiner*—Eric Hug
(74) *Attorney, Agent, or Firm*—Taylor & Aust, P.C.

(57) ABSTRACT

An air press for pressing a paper web is composed of a plurality of rolls including at least a first roll and a second roll. The first roll and the second roll are positioned adjacent one another and form a first nip therebetween. Further, the first roll and the second roll each have a roll end, the roll end of the first roll adjoining the roll end of the second roll. A bevel plate is attached to the roll end of the first roll, the bevel plate having at least a first angled plate face. A seal ring is positioned adjacent the roll end of the second roll, the seal ring being juxtaposed to the bevel plate. The seal ring has at least a first angled ring face, and the first angled ring face mates with the first angled plate face.

45 Claims, 11 Drawing Sheets

CROSS-DIRECTIONAL INTERLOCKING OF ROLLS IN AN AIR PRESS OF A PAPERMAKING MACHINE

STATEMENT REGARDING FEDERALLY SPONSORED RESEARCH OR DEVELOPMENT

This invention was made with Government support under Prime Contract No. DE-FC36-01GO10622 awarded by the Department of Energy. The Government has certain rights in this invention.

BACKGROUND OF THE INVENTION

1. Field of the Invention

The present invention relates to air presses in papermaking machines, and, more particularly, to multi-roll cluster arrangements used in such air presses.

2. Description of the Related Art

Effective water removal from a paper web is essential to the papermaking process. Various types of presses, using some combination of juxtaposed rolls, have been used for some time now for water removal. Such presses rely on the hydraulic pressure created at the nip between each pair of juxtaposed rolls through which the paper web travels in a given press configuration to drive water from the paper web.

Various press have been developed which have attempted to add an element of a positive air pressure within the press assembly to more effectively force the water from the paper web. With respect to roll presses specifically, the rolls of the press have been configured to form a chamber with a positive air pressure being supplied therewithin.

However, the effectiveness of a multi-roll air presses is limited by the degree to which the air chamber thereof can be sealed. The areas of the press where sealing becomes quite crucial are those areas where the paper web and the fabric(s) carrying it do not pass, as the web/fabric(s) combination inherently acts to seal the region of each nip through which it passes. Those regions of the air press through which the paper web/fabric(s) combination does not pass are the opposed lateral ends of each nip and the opposed chamber ends defined by the two sets of roll ends associated with the air press. Consequently, an end seal mechanism is provided at each chamber end, each such mechanism having a seal member which contacts each of the roll ends associated with that particular chamber end.

However, the ability of the end seal mechanism to efficiently seal a chamber is predicated on the seal member maintaining contact with each of the roll ends of that chamber end. If the roll ends are not aligned with one another, the seal member can come out of contact with at least one of the roll ends and thereby create a leakage site in the seal.

What is needed in the art is a system for maintaining alignment of each roll end set in order to promote full contact of an adjacent end seal mechanism therewith.

SUMMARY OF THE INVENTION

The present invention provides a multi-roll air press in which each end of a first roll is all provided with a bevel plate and each end of a second roll adjoining the first roll is provided with one of a seal ring and a gasket assembly, each bevel plate mating with the one of a seal ring and a gasket assembly in a manner that helps hold an end of the first roll in alignment with a corresponding end of the second roll.

The invention comprises, in one form thereof, an air press for pressing a paper web. The air press is composed of a plurality of rolls including at least a first roll and a second roll. The first roll and the second roll are positioned adjacent one another and form a first nip therebetween. Further, the first roll and the second roll each have a roll end, the roll end of the first roll adjoining the roll end of the second roll. A bevel plate is attached to the roll end of the first roll, the bevel plate having at least a first angled plate face. A seal ring is positioned adjacent the roll end of the second roll, the seal ring being juxtaposed to the bevel plate. The seal ring has at least a first angled ring face, and the first angled ring face mates with the first angled plate face.

In another form thereof, the invention comprises an air press for pressing a paper web. The air press is composed of a plurality of rolls including at least a first roll and a second roll. The first roll and the second roll are positioned adjacent one another and form a first nip therebetween. The first roll and the second roll each have a roll end, the roll end of the first roll adjoining the roll end of the second roll. A bevel plate is attached to the roll end of the first roll, and the bevel plate has at least a first angled plate face. A replaceable wear assembly includes a gasket, the gasket being attached to the roll end of the second roll. The gasket has a first beveled gasket edge, and the first beveled gasket edge mates with the first angled plate face.

An advantage of the present invention is that the interlocking of the rolls of the air press in a cross-machine direction maintains corresponding roll ends in alignment during operation the press, and such alignment is a precondition for minimizing leakage through the lateral seals of the air press.

Another advantage is a bevel plate and an adjoining cap seal ring can be configured to key into one another, promoting good sealing and alignment therebetween and substantially preventing any cap roll cover bulge and/or roll width variations from affecting the seal area therebetween.

Yet another advantage is the cap seal ring and the cap roll cover can be engineered to minimize and/or accommodate any stress build-up therebetween.

An additional advantage is that the compressibility of the floating cap design ensures that a seal can be achieved even if there is misalignment internally between rolls, by accommodating misalignment of roll ends.

A further advantage is an adjustable loading system can be supplied that is capable of continually applying a smallest possible force on the rolls needed to maintain a seal, even if the air pressure to be sealed against should change, thereby causing as little wear as possible to occur between a bevel plate and an adjoining cap seal ring.

A yet even further advantage is that a pneumatic expansion tube and/or a spring can be used in conjunction with the cap seal ring to help ensure contact and thus sealing of the cap seal ring with an adjoining bevel plate.

An additional advantage is that a gasket assembly with a replaceable gasket can be used instead of a cap seal ring, the gasket generally being more readily replaced than an entire cap seal ring.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
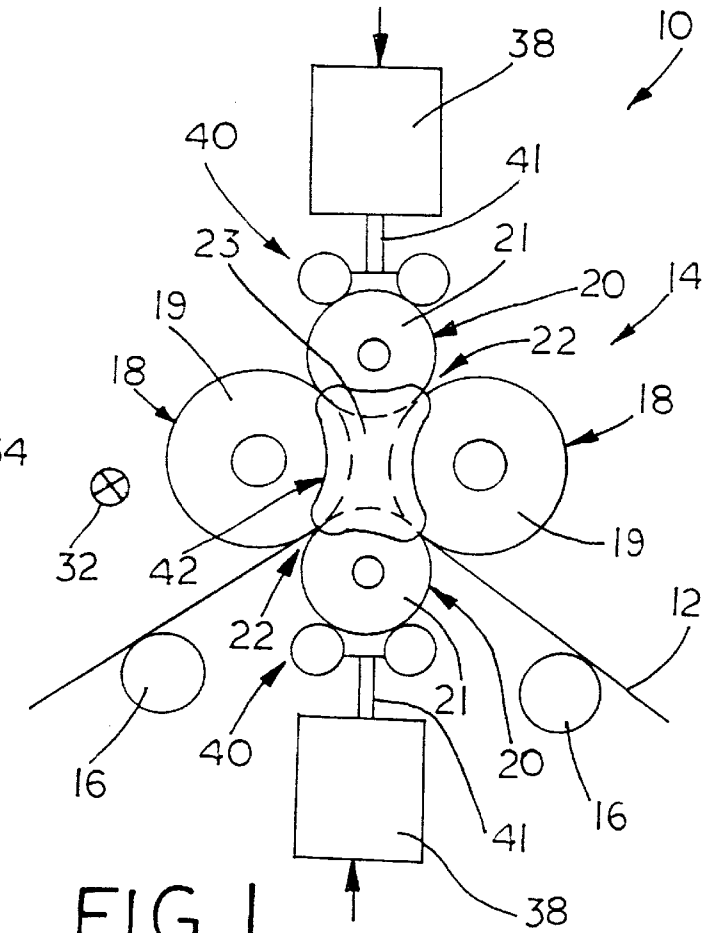
FIG. 1 is a schematic, side view of an embodiment of a papermaking machine of the present invention.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF THE INVENTION

Referring now to the drawings, and more particularly to FIG. 1, there is shown a papermaking machine 10 for making a fiber web 12 which generally includes an air press 14 and a plurality of conveyor rolls 16.

Figure 4:
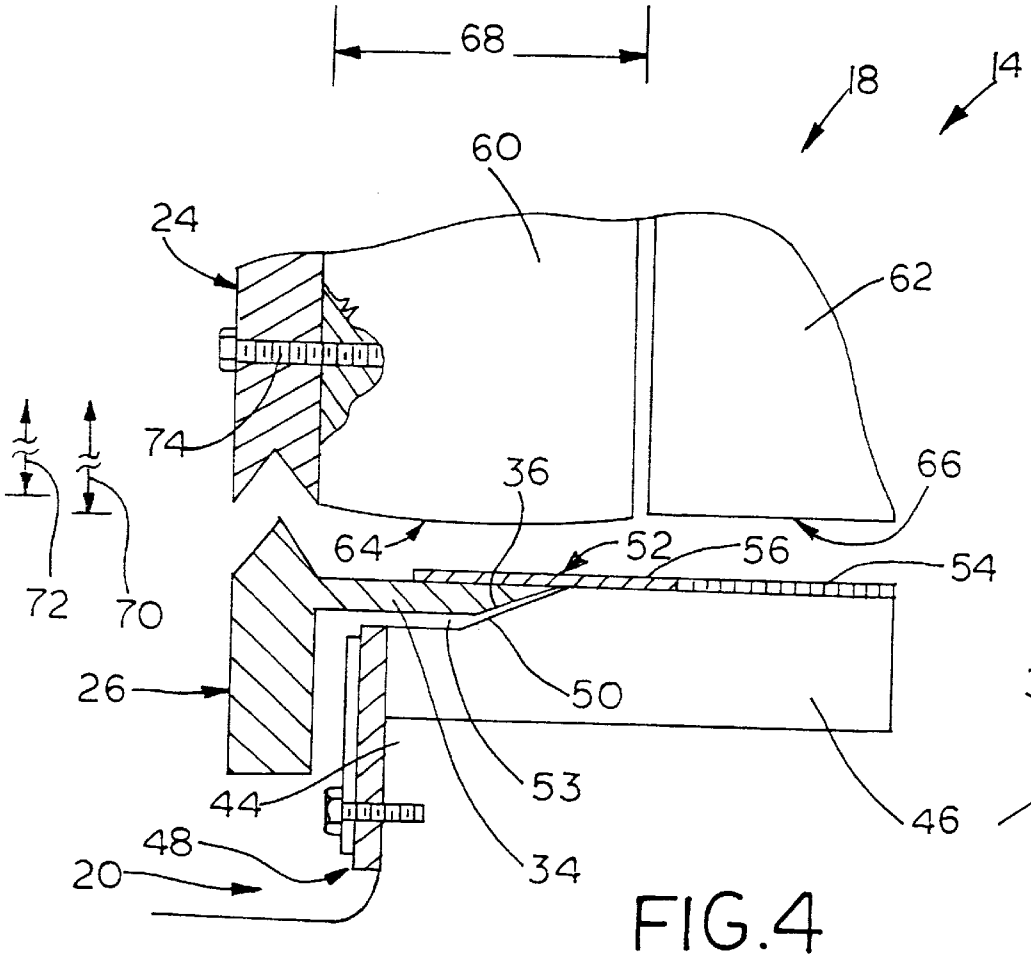
FIG. 4 is a schematic, perspective view of a variation of the set of ends shown in FIG. 3.
Figure 2:
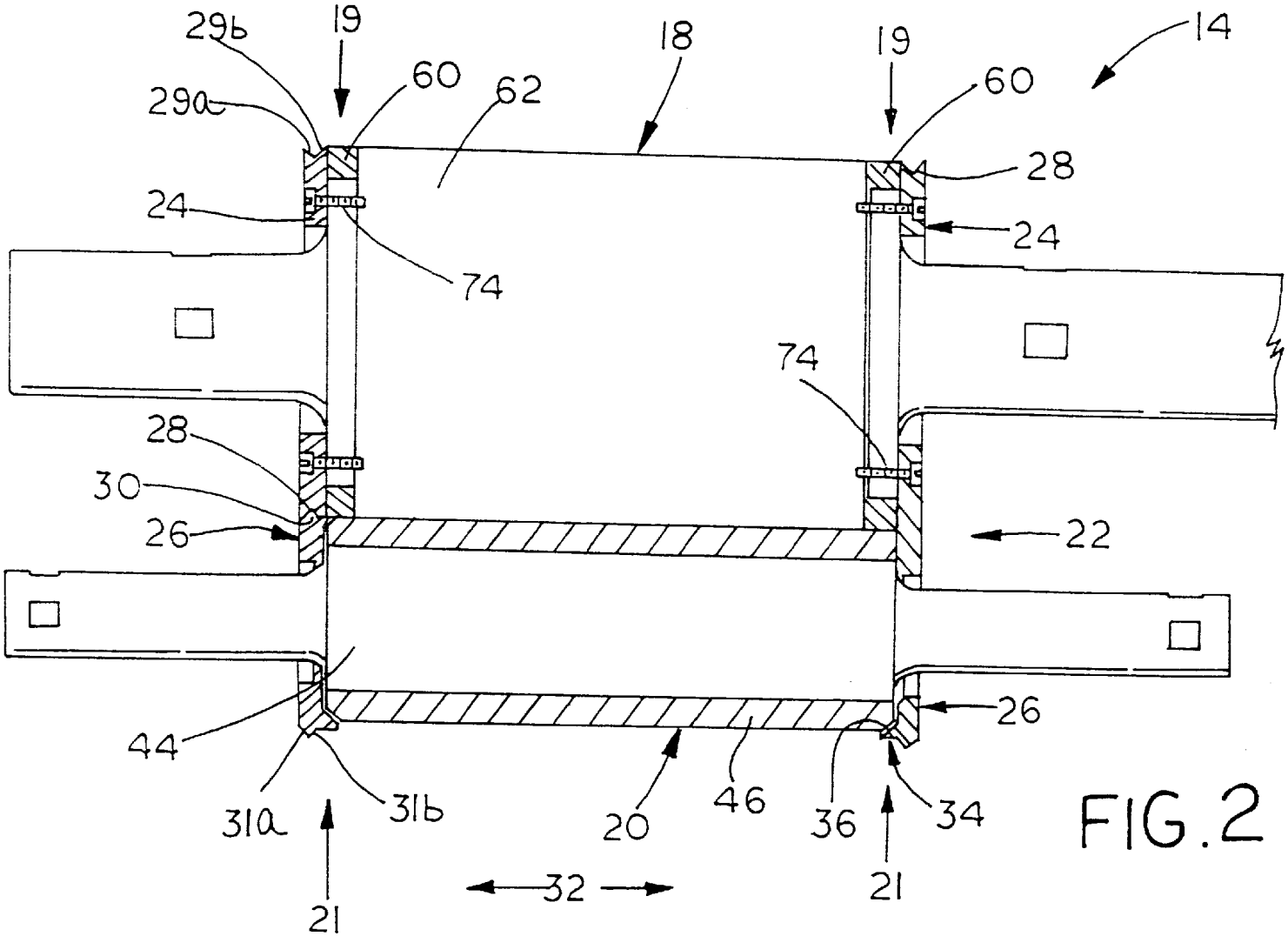
FIG. 2 is a perspective, partially-sectioned view of a main roll and an adjoining cap roll of the air press of the papermaking machine shown in FIG. 1.
Figure 3:
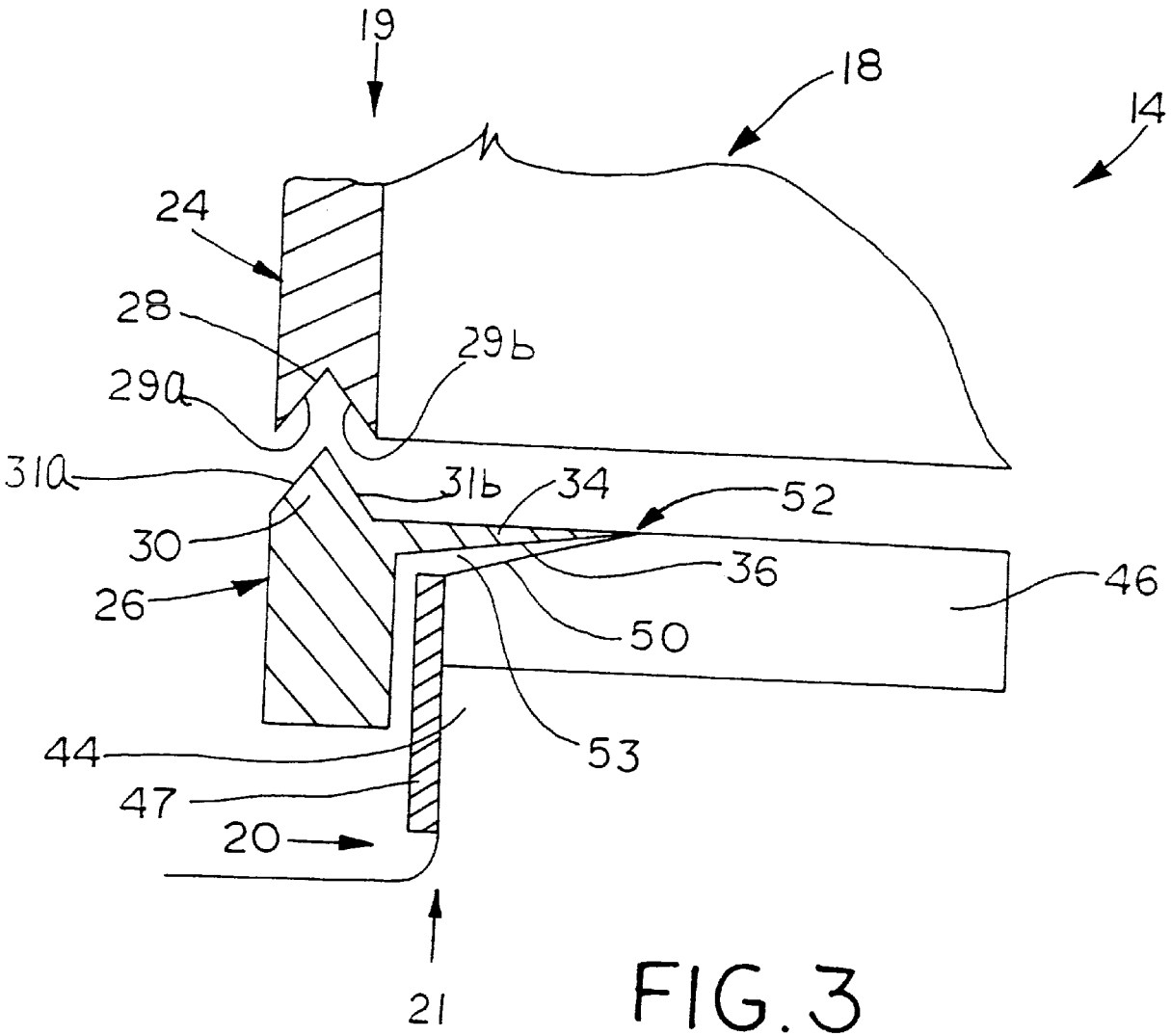
FIG. 3 is a schematic, perspective view of a set of ends of the main roll and the adjoining cap roll shown in FIG. 2.

Air press 14 includes a pair of main rolls 18 and a pair of cap rolls 20 aligned with one another so as to form a plurality of nips 22 therebetween and define an air pressure chamber 23. One such main roll 18 and cap roll 20 juxtaposed thereto are illustrated in FIG. 2. At each main end 19 of main rolls 18 and each cap end 21 of cap rolls 20 are mounted bevel plates 24 and cap seal rings 26, respectively. Bevel plates 24 and cap seal rings 26 are may be made of a hard and/or low-friction material, such as steel, brass, nylon or a suitable bushing material, to allow for a long life thereof Bevel plates 24 and cap seal rings 26 are provided with a beveled notch 28 (FIGS. 2–4) and a beveled key 30, respectively, to permit each set of adjoining bevel plates 24 and cap seal rings 26 to matingly seal and thereby interlock main rolls 18 and cap rolls 20 in a cross-machine direction 32. (Cross-machine direction 32 is also commonly referred to as the CD-direction.) Because of such keying action, bulging of cap roll 20 and/or roll width variations do not affect the seal area between each set of adjoining bevel plates 24 and cap seal rings 26. Beveled notch 28 includes a first angled notch surface 29*a* and a second angled notch surface 29*b*. Likewise, beveled key 30 has a first angled key surface 31*a* and a second angled key surface 31*b*. Cap seal ring 26 further has an orthogonal extension 34 that has a beveled extension face 36 (two possible forms of which are best shown in FIGS. 3 and 4) configured to mate with adjoining cap roll 20. As can be seen from FIGS. 3 and 4, cap seal ring 26 is not directly fastened to or adhered upon cap roll 20 and thus is considered to be a "floating" cap seal ring.

Air press 14 further includes an air cylinder 38 and a corresponding cap seal ring pulleys 40 associated with each cap roll 20; and an end seal arrangement 42 associated with main ends 19 and cap ends 21. Air cylinder 38 and cap seal ring pulleys 40 associated with each cap roll 20 together define an air cylinder loading system 41 capable of supplying a sufficient load to cap seal ring 26 to offset the air pressure inside air pressure chamber 23, so there is the smallest load possible upon each cap roll 20 needed to maintain a seal between each juxtaposed bevel plate 20 and cap seal ring 22 and to thereby achieve a long life for bevel plate 20 and cap seal ring 22.

Air pressure chamber 23 has an air chamber pressure associated therewith, and as the total load needed to maintain such a seal will vary with the air chamber pressure, each air cylinder loading system 41 is configured to adapt the load exerted thereby to changes in air chamber pressure. Each cap seal ring pulley 40 may be mounted on bearings (not shown) so that little wear occurs at loading points. Further, the cross section (not labeled) of each cap seal ring pulley 40 can be matched with that of corresponding cap seal ring 22 so that cap seal ring pulley 40 helps guide corresponding cap seal ring 22 in cross-machine direction 32. For a simple system, it is possible to make the air cylinder piston area (not labeled) inside air cylinder 38 a bit larger than the chamber area (not labeled) associated with cap seal rings 22, allowing air cylinder 38 to be directly connected to the air chamber pressure and thereby permit loading cylinder forces to "track" air chamber pressure. Optionally, a control system (not shown) can be provided to harmonize the air chamber pressure and the force exerted by each air cylinder 38.

Each cap roll 20 includes a cap roll core 44, a cap roll cover 46 positioned on cap roll core 44. Associated with each cap end 21 is either a cap-end wear gasket 47 (FIG. 3) or a cap-end wear assembly 48 (FIG. 4). For example, cap roll core 44 is made of steel or another suitable metal or alloy, and cap roll cover 46 is made of rubber or another elastomeric material. Cap roll cover 46 may be made of a harder rubber in order to add to cover life and reduce heat buildup therein, consistent with sealing to web 54 (FIG. 4).

Proximate each cap end 21, cap roll cover 46 has a beveled cover portion 50 that mates with corresponding orthogonal extension 34 of cap seal ring 26 and beveled extension face 36 associated therewith, thereby forming a ring-cover seal 52 therebetween. With normal cap roll compression and air chamber pressure, orthogonal extension 34 will be sealingly forced into cap roll cover at ring-cover seal 52.

There is an anticipated potential speed difference between cap seal ring 26 and cap roll cover 46 since cap seal ring 26 is rigid and cap roll cover 46 is elastomeric, resulting in a different radius of rotation for each. To handle this potential speed differential, it is possible to make the diameter (not labeled) of cap seal ring 26 slightly larger than that of cap roll cover 46, allowing orthogonal extension 34 to separate from beveled cover portion 50 radially away from ring-cover seal 52 to form a ring-cover gap 53 (as illustrated in each of FIGS. 2 and 3) in radial regions away from nip 22 between main roll 18 and corresponding cap roll 20, helping to relieve any built up stresses developed in the region of ring-cover seal 52. Additionally, cap roll cover 46 can be made of a material with a high modulus of elasticity (i.e., highly elastic) and/or a low coefficient of elasticity (i.e., slippery) to better accommodate stresses which may build at ring-cover seal 52. Further, orthogonal extension 34 and beveled cover portion 50 may be configured to permit at least a small amount of slippage to occur therebetween.

Cap roll cover 46, for example, is provided with a permeable membrane 54 (FIG. 4) thereon that extends over a substantial portion of the length thereof, including the central portion (relative to cross-machine direction 32) thereof Permeable membrane 54 acts as a further aid for removing water from fiber web 12. Adjacent permeable membrane 54 near each ring-cover seal 52, cap roll cover 46 has an impermeable membrane 56 attached thereon, impermeable membrane 56 extending across ring-cover seal 52 and onto orthogonal extension 34 of cap seal ring 26. Impermeable membrane 56 may favorably minimize the leakage through ring-cover seal 52. However, a sufficient seal can still be obtained if impermeable membrane 56 does not extend across ring-cover seal 52 or even if impermeable membrane 56 is not present, Each main roll 18 may actually include at least three portions (as shown in FIGS. 2, 4), relative to cross-machine direction 32, which can be advantageous, for example, when impermeable membrane 56 is employed upon cap roll 20. Specifically, each main roll 18 has a pair of edge portions 60 and a middle portion 62. Each edge portion 60 extends to one of main ends 19. Middle portion 62 is located between edge portions 60, with edge portions 60 being replaceably mounted thereagainst by bevel plates 24.

Each edge portion 60 has at least an edge surface portion 64 composed of a first material, the first material having a first hardness, and middle portion 62 has a middle surface portion 66 composed of a second material, the second material having a second hardness, the second material being harder than the first. Specifically, the first material, for example, is a soft, elastic rubber or other suitable elastomer and has a softness of greater than 20 P & J (P & J is a hardness unit based upon Pusey & Jones standard measurement; plastometer (P&J) readings increase with softer materials; they measure the indentation of a ⅛-inch diameter ball under one kilogram of weight for one minute and preferably at least about 100 P & J. Conversely, the second material, for example, is one of a steel, a ceramic material, a hard rubber, and a hard plastic and has a lower P&J than the first material.

The size and shape of edge portion 60 and edge surface portion 64 are chosen based upon specific parameters. Edge width 68 extends beyond ring-cover seal 52 in order to achieve sufficient sealing. Edge surface portion 64 must be made convex to avoid caving in due to the air pressure within air press 14. Edge surface portion 64 can be made convex by crowning edge portion 60 during forming and/or by causing edge portion to bulge. As such, when mounted, edge portion 60 has a maximum edge diameter 70 (schematically shown) that is greater than a maximum middle diameter 72 (schematically shown) of middle portion 62. Bevel plate 24 is held onto edge portion 60 by threaded fasteners 74, and tightening thereof can be used to produce a desired bulge in edge surface portion 64. Tightening of bevel plate 24 against edge portion 60 offers the further advantage of placing edge portion 60 under compression, thereby adding to the life of the rubber, as cracks do not tend to propagate in a material placed under compression.

FIGS. 5*a*–5*d* illustrate variations of a second general embodiment of an air press 80. Air press 80, in each of the variations, includes a main roll 82 and a cap roll 84. Cap roll 84 includes a roll journal 86, a cap roll core 88 (e.g., made of steel) and an elastic roll cover 90. Main roll 82 has a main end 92, and cap roll 84 has a cap end 94. Attached to cap end 94 is a shim gasket 96. Only the features of the variations of air press 80 which differ from those of air press 14 are discussed in further detail herewith.

Figure 5A:
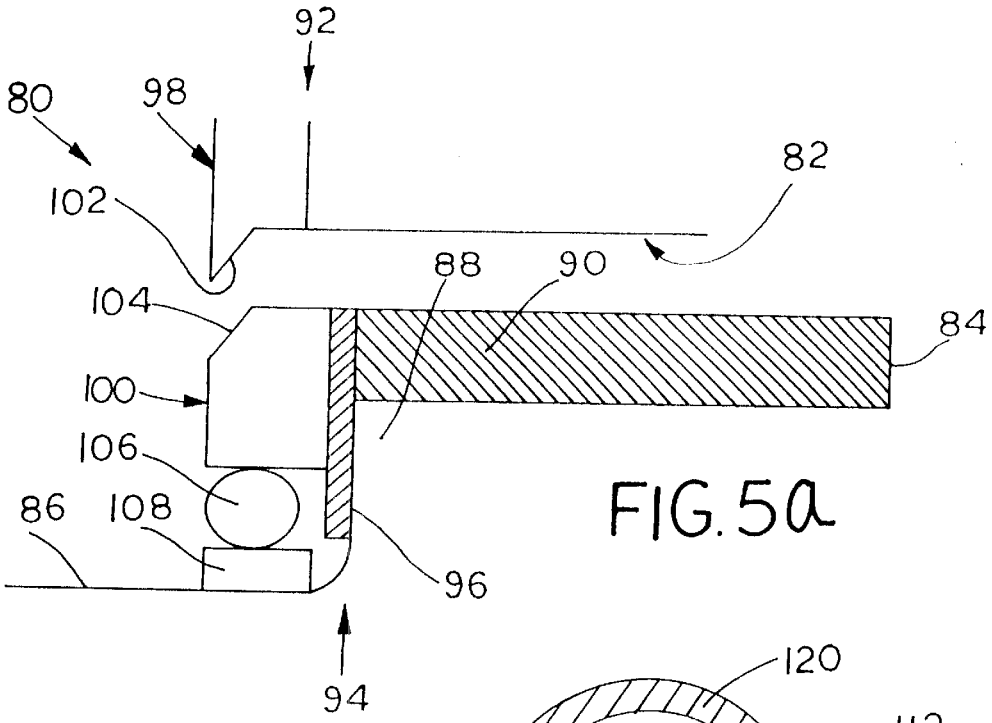
FIGS. 5*a*–5*d* are schematic, perspective views of variations of a second general embodiment of the construction of a set of ends of a main roll and an adjoining cap roll.
Figure 5D:
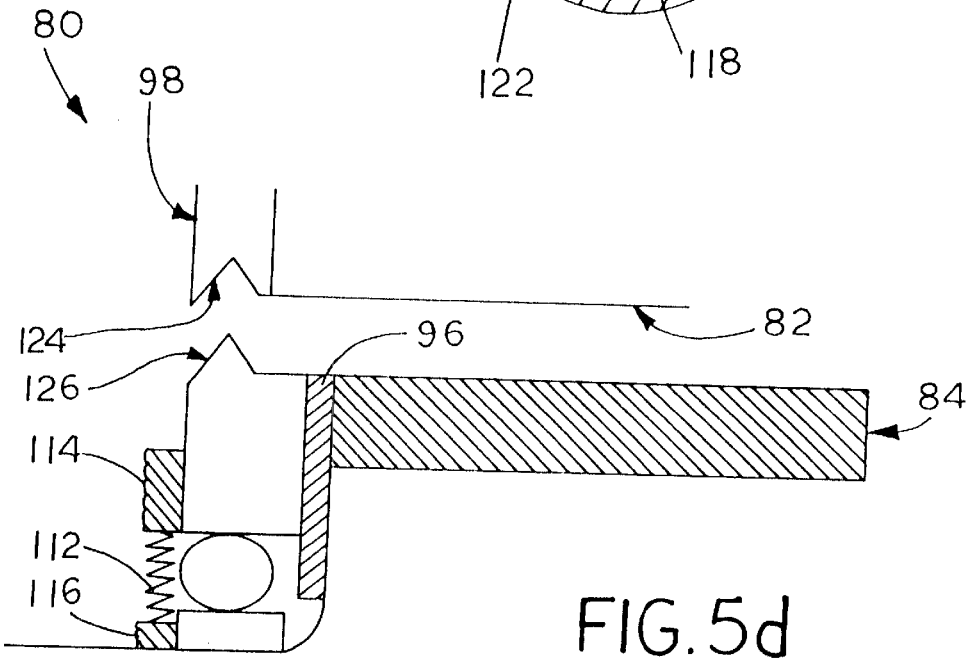
Figure 5B:
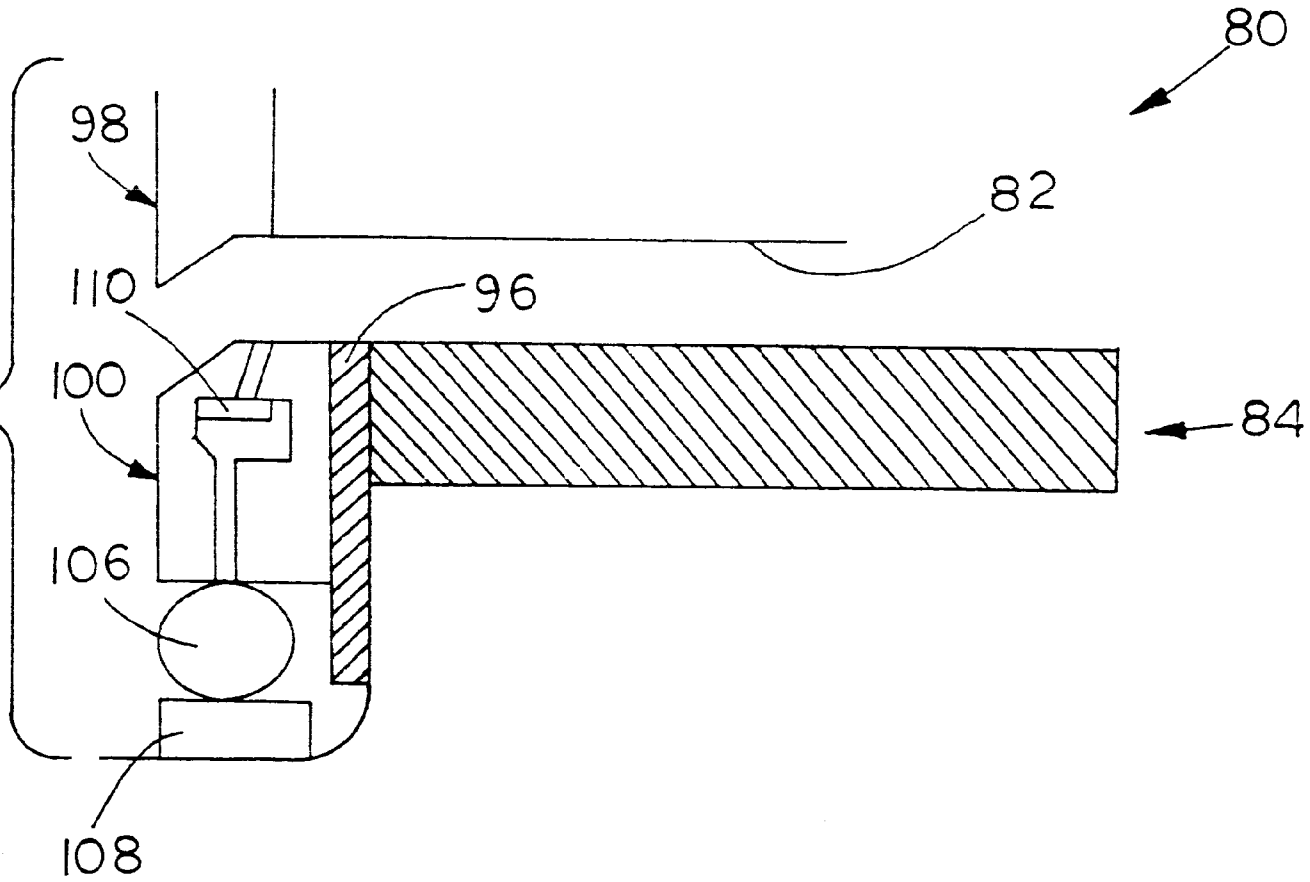
Figure 5C:
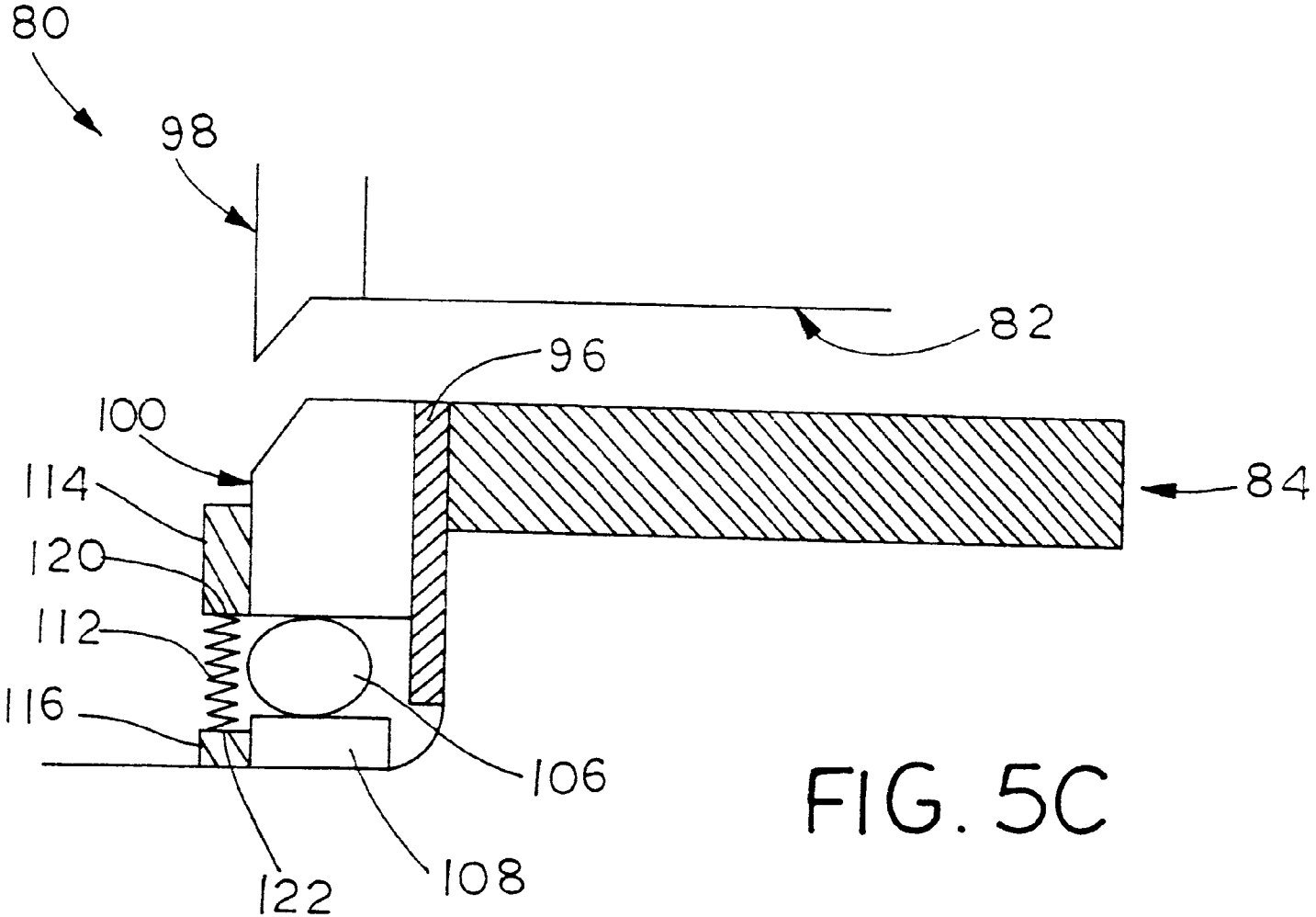

With respect to the variations shown in FIGS. 5*a*–5*c*, main end 92 has a bevel plate 98 attached thereto, and shim gasket 96 on cap end 94 has a cap seal ring 100 positioned thereagainst. Bevel plate 98 includes a first angled plate surface 102 which faces both inward toward main roll 82 and downward toward cap seal ring 100. Conversely, cap seal ring 100 includes a first angled ring surface 104 which faces both outward away from cap roll 84 and upward toward bevel plate 98. As such, first angled plate surface 102 is configured to mate with first angled ring surface 104 and to thereby force cap roll 84 into lateral alignment with main roll 82.

In order to help bias cap roll 84 into contact with bevel plate 98, a pneumatic expansion tube 106 is provided between cap seal ring 100 and roll journal 86. The force applied by pneumatic expansion tube 106 should be the lowest possible needed to maintain a seal between bevel plate 98 and cap seal ring 100. A support block 108 is mounted on roll journal 86 for carrying pneumatic expansion tube 106. However, it is conceivable that pneumatic expansion tube 106 could be carried directly upon roll journal 86.

To control the force applied by pneumatic expansion tube 106, a control system (not shown) can be supplied, or, as shown in FIG. 5*b*, cap seal ring 100 can be provided with a one way valve 110, and pneumatic expansion tube 106 can be modified to have a slow leak therefrom. In the arrangement shown in FIG. 5*b*, one way valve 110 samples the air pressure associated with air press 80. If the air pressure is higher than the pneumatic pressure of pneumatic expansion tube 106, one way valve 110 opens allowing air to flow into pneumatic expansion tube 106 until the air pressure and the pneumatic pressure equalize or the pneumatic pressure becomes greater, prompting the closing of one way valve 110. Due to the slow leak in pneumatic expansion tube 106, should the air pressure drop below the pneumatic pressure, the pneumatic pressure will eventually drop to match the air pressure.

The variation shown in FIG. 5*a* may be further modified to provide an external spring element 112, as shown in FIG. 5*c*. External spring element 112 can be configured for maintaining pressure axially to force cap seal ring 100 into shim gasket 96. Such an axial force helps maintain a seal between cap seal ring 100 and shim gasket 96 and to allow cap seal ring 100 to move yet still be supported by cap roll 84. Additionally, external spring element 112 can be designed to make up a difference in pressure not supplied by pneumatic expansion tube 106 needed to maintain contact and sealing between cap seal ring 100 and bevel plate 98.

In FIG. 5*c*, external spring element 112 is shown mounted to first mounting block 114 and second mounting block 116. First mounting block 114 is attached to cap seal ring 100, and second mounting block 116 is attached to support block 108. However, it is contemplated that external spring element 112 could be directly attached to cap seal ring 100 and/or roll journal 86 and that second mounting block could also or instead be mounted to roll journal 86.

Figure 6:
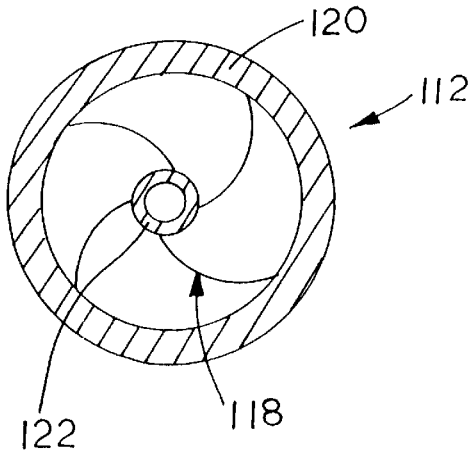
FIG. 6 is a top, schematic view of the external spring shown in FIG. 5*c*.

As illustrated in FIG. 6, external spring element 112 can have a spider web design 118, a first attachment site 120 (for attachment to first mounting block 114) and a second attachment site 122(for attachment to second mounting block 116). Spider web design 118 has the benefits of having spring elements that are long enough such that overall deflection per unit length is low, reducing fatigue and increasing spring life; limiting movement of cap seal ring 100 before occurrence of slippage; allowing limited rotation of outer and inner rings relative to one another before slippage can occur; and setting, via the design of spring element cross section, the amount of axial pressure on cap seal ring 100. For example, using a thin, ribbon cross section with the flat surface parallel to the roll cross direction (CD) results in a spring constant which is much higher in the axial direction (i.e., toward cap roll 84) than in a radial direction (i.e., toward bevel plate 98).

The variation shown in FIG. 5*d* differs from the one shown in FIG. 5*c* in that bevel plate 98 is provided with a beveled notch 124 and that cap seal ring 100 has a beveled key 126, beveled notch 124 and beveled key 126 forming a mating seal in manner similar to beveled notch 28 and beveled key 30 in the first general embodiment.

A third general embodiment, including multiple variations thereof, is shown in FIGS. 7*a*–7*j*. Air press 130 of the third embodiment differs from air presses 14 and 80 of the first two embodiments primarily in that a gasket assembly 132 is used instead of one of cap seal rings 26 and 100. Other than the use of gasket assembly 132, the construction of air press 130 is similar to that of air press 80. Specifically, air press 130 includes a main roll 134 and a cap roll 136. Cap roll 136 includes a roll journal 138, a cap roll core 140 (e.g., made of steel) and an elastic roll cover 142. Main roll 134 has a main end 144, and cap roll 136 has a cap end 146. Main end 144 has a bevel plate 148 attached thereto, and bevel plate 148 includes a first angled plate surface 150 which faces both inward toward main roll 134 and downward toward gasket assembly 132.

Gasket assembly 132 includes a gasket 152 made of, e.g., rubber or other elastomeric material; a bracket member 154 made of, e.g., a metal or another resilient material; and, in most of the illustrated variations, a bracket fastener 156 (e.g., a bolt or screw) for attaching bracket member 154 to cap roll core 140. Gasket 152 offers the advantage of being relatively easy and inexpensive to replace, especially with respect to cap seal rings 26 and 100 of the other embodiments. Gasket 152 has a main gasket portion 158 which includes a first angled gasket surface 160 and a second angled gasket surface 162. First angled gasket surface 160 faces both outward away from cap roll 136 and upward toward bevel plate 148. As such, first angled plate surface 150 is configured to mate with first angled gasket surface 160 and to thereby force cap roll 136 into lateral alignment with main roll 134. First angled plate surface 150 also helps avoid bulging in gasket 152 once main roll 134 and cap roll 136 are pressed together. Additionally, bracket member 154 has an angled bracket surface 164 which faces and mates with second angled gasket surface 162 to thereby help position and hold gasket 152 in place. In the variations shown, gasket 152 is bonded to at least one of bracket fastener 164 and cap end 146.

Figure 7A:
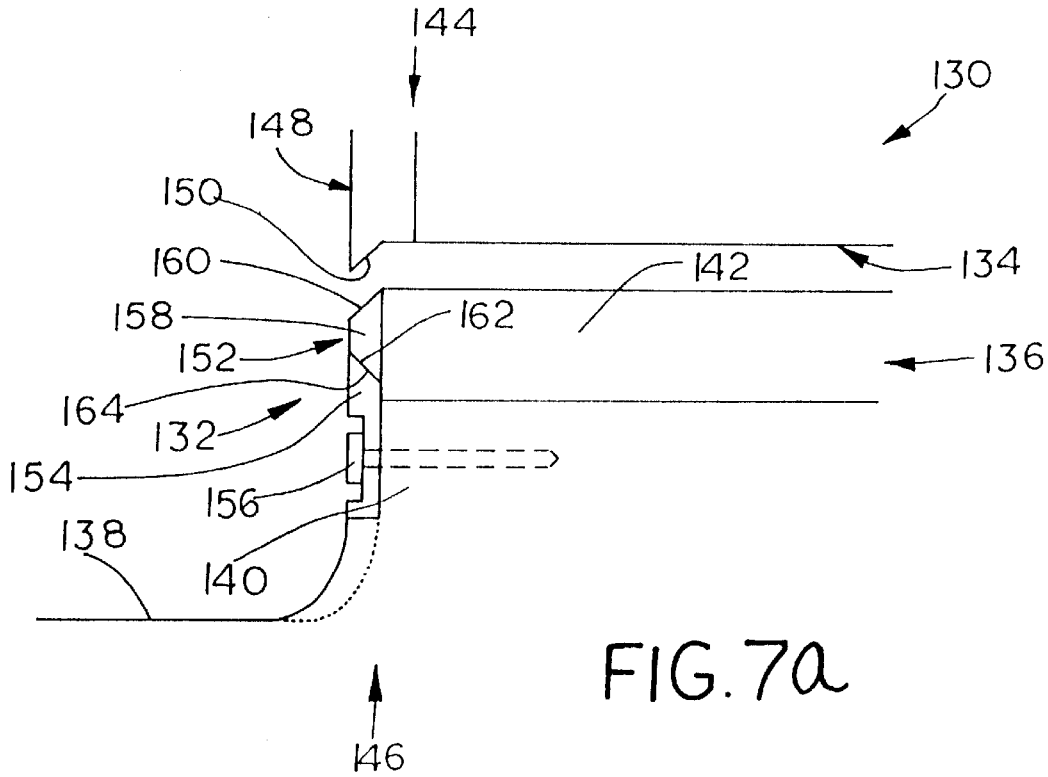
FIGS. 7*a*–7*j* are schematic, perspective views of variations of a third general embodiment of the construction of a set of ends of a main roll and an adjoining cap roll.
Figure 7B:
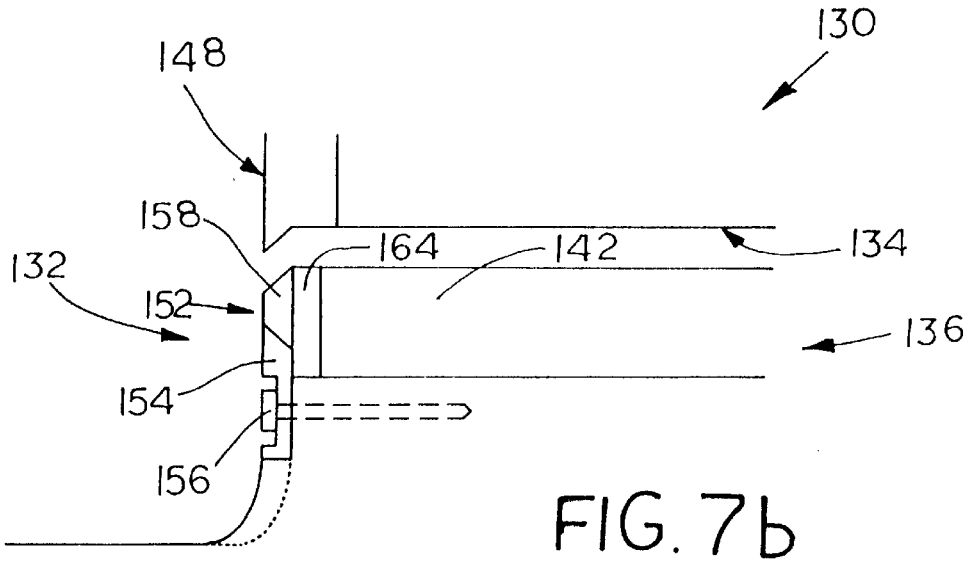
Figure 7C:
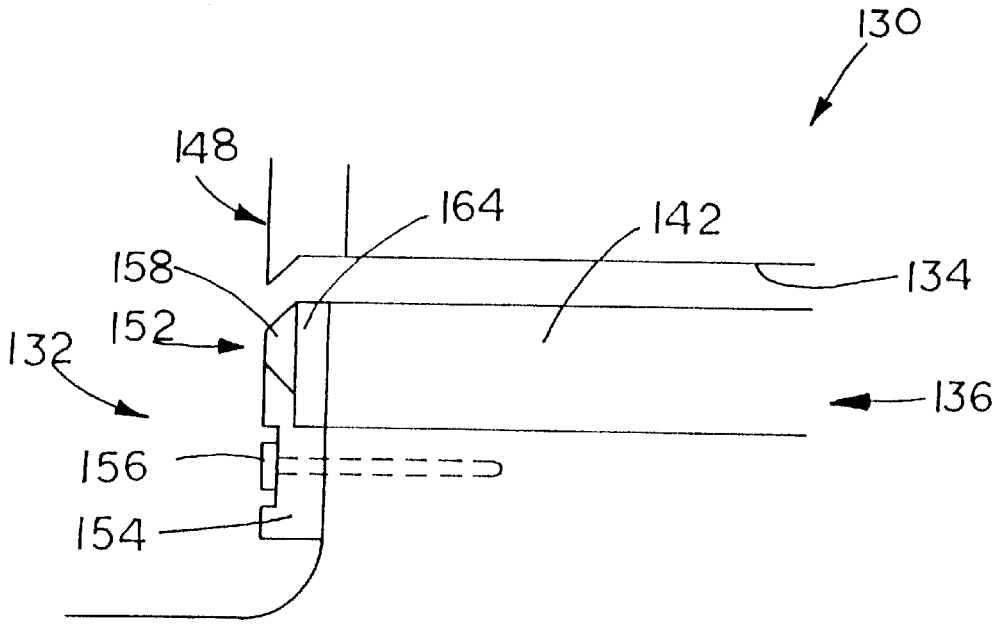

The variations of air press 130 shown in FIGS. 7*b* and 7*c* differ from the one shown in FIG. 7*a* in that gasket 152 further includes a gasket extension 164 located between cap end 146 and main gasket portion 158. Gasket extension 164 is configured to contact bracket member 154 to thereby enhance adhesion between bracket member 154 and gasket 152. In FIG. 7*b*, gasket extension 164 substantially coincides with roll cover 142. In the variation shown in FIG. 7*c*, the size and shape of bracket member 154 is altered so that bracket member 154 further extends below gasket extension 164 to provide even greater contact between bracket member 154 and gasket 152.

Figure 7D:
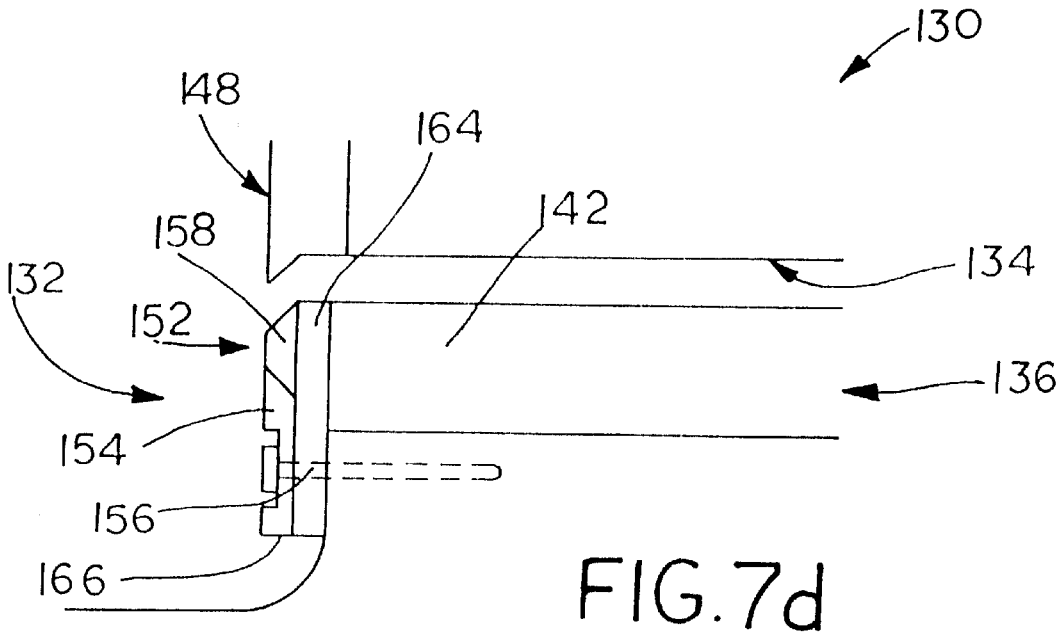

In the variation illustrated in FIG. 7*d*, gasket extension 164 is modified from the version shown in FIG. 7*b* so as to extend substantially to distal bracket end 166 and to receive bracket fastener 156 therethrough, thereby maximizing the potential contact area with bracket member 154 and increasing the positional stability thereof by its connection with bracket fastener 156.

Figure 7E:
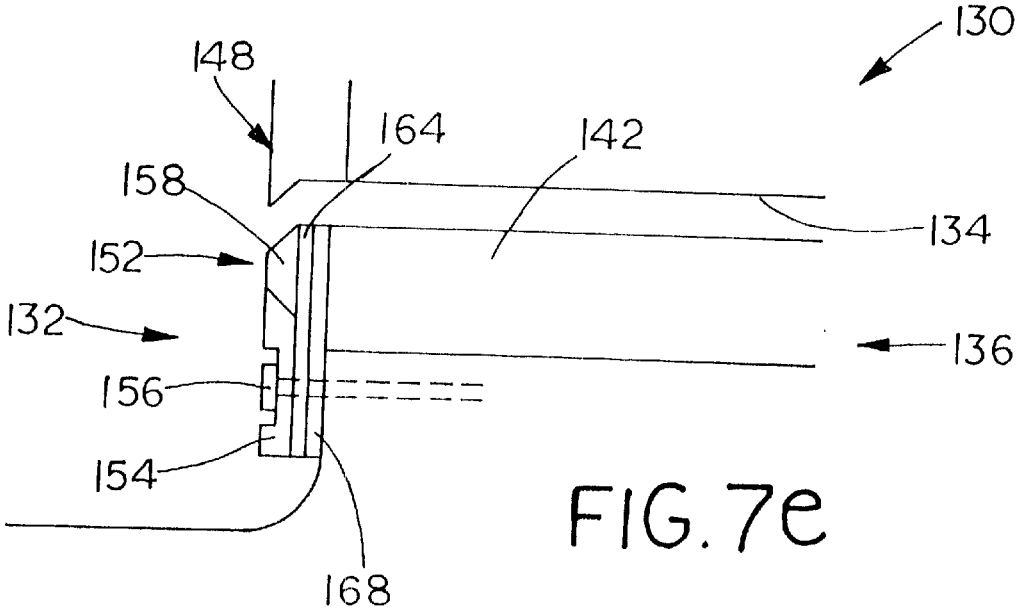
Figure 7F:
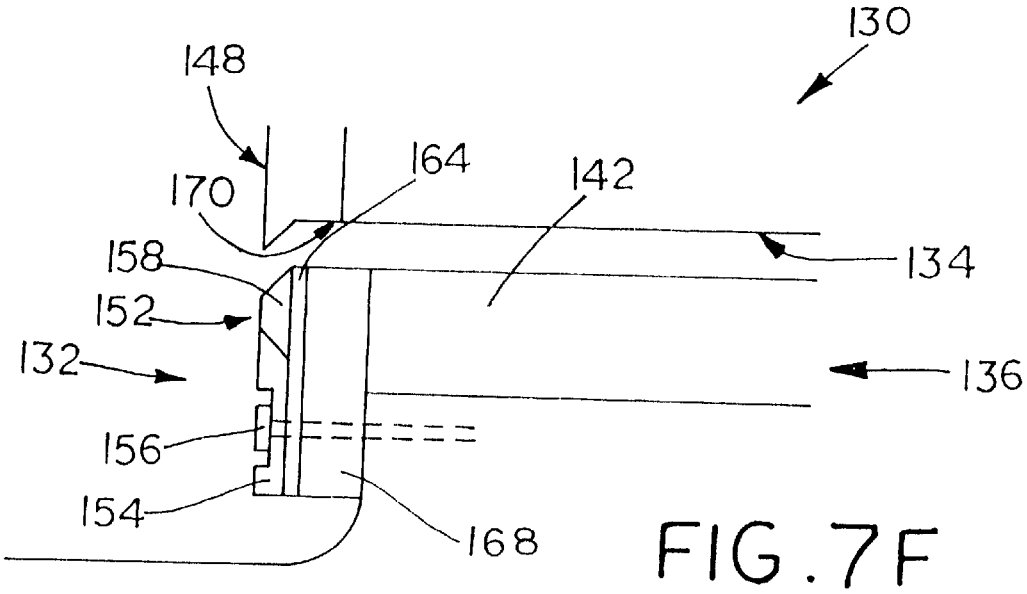

The variations shown in FIGS. 7*e* and 7*f* are similar to the version of FIG. 7*d* except that they each include an additional shim gasket 168 positioned between gasket extension 164 and cap end 146. In FIG. 7*e*, shim gasket 168 is thin, while in FIG. 7*f*, shim gasket 168 is thick enough so as to contact plate-roll joint 170 between bevel plate 148 and main roll 134. By contacting plate-roll joint 170, shim gasket 168 can enhance sealing thereat should bevel plate 148 and main roll 134 not be in perfect alignment.

Figure 7G:
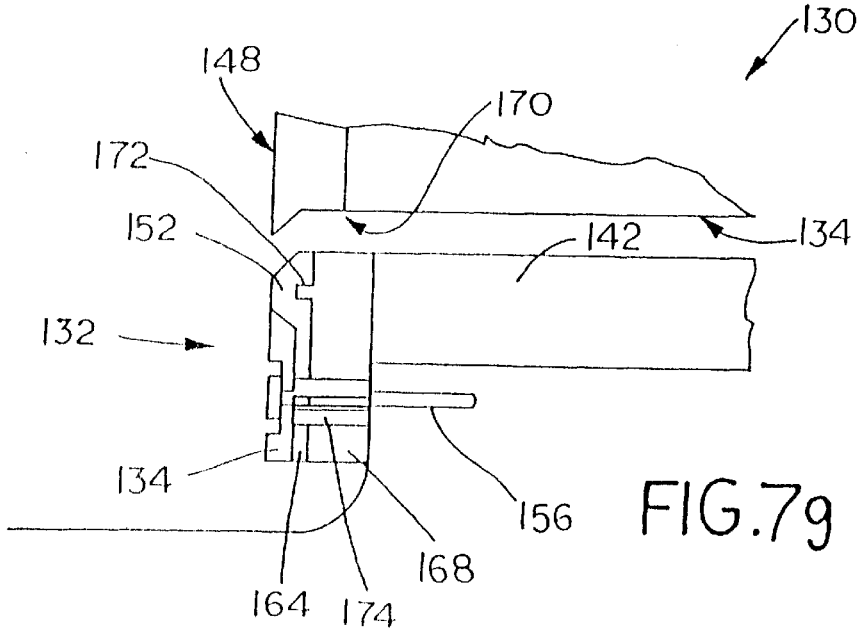

The version illustrated in FIG. 7*g* varies from that of FIG. 7*f* in that gasket 152 is provided with a groove 172 therein adjacent shim gasket 168 and opposite main gasket portion 158 and in that a metal spacer 174 is mounted in both gasket extension 164 and shim gasket 168 and is configured to receive bracket fastener 156 therethrough. Groove 172 is configured to make gasket 152 more flexible radially by easing bending thereof. As such, the presence of groove 172 permits gasket 152 to made of a harder and, thus, more wear resistant material.

Figure 7J:
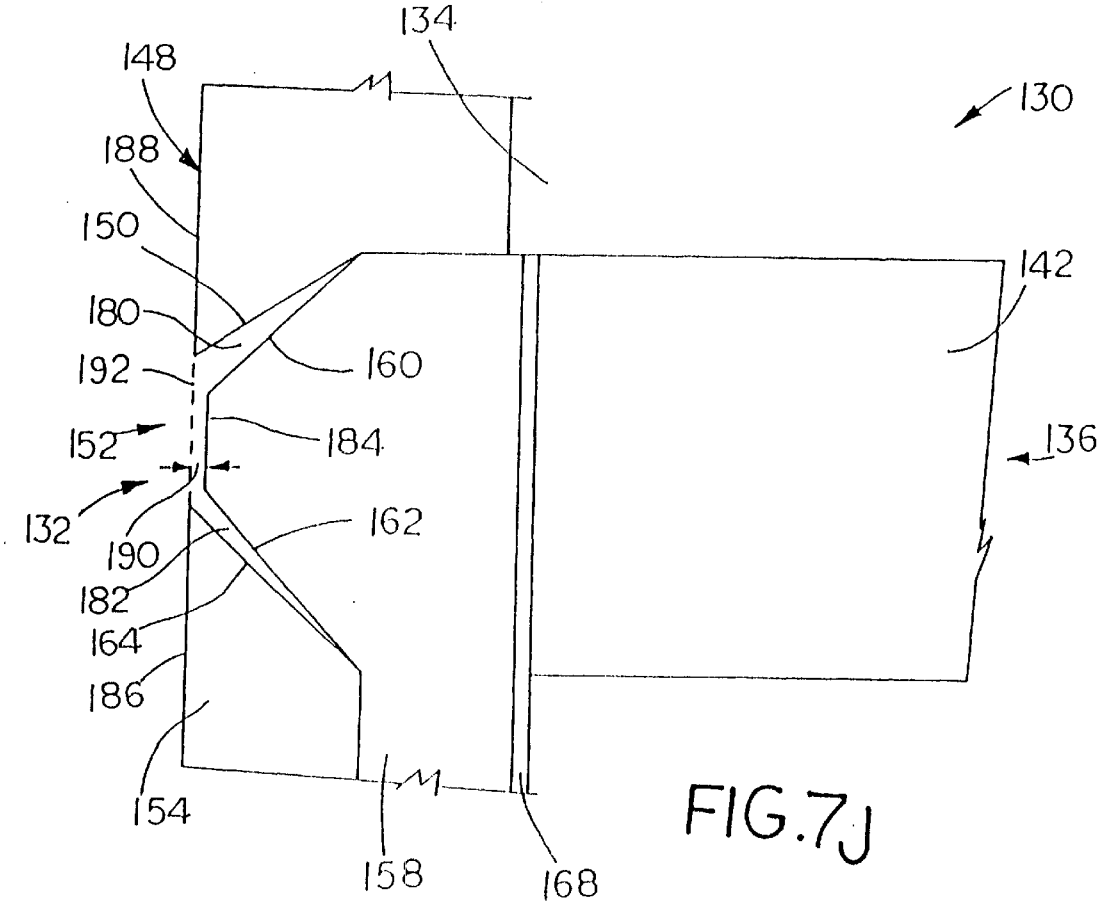
Figure 7H:
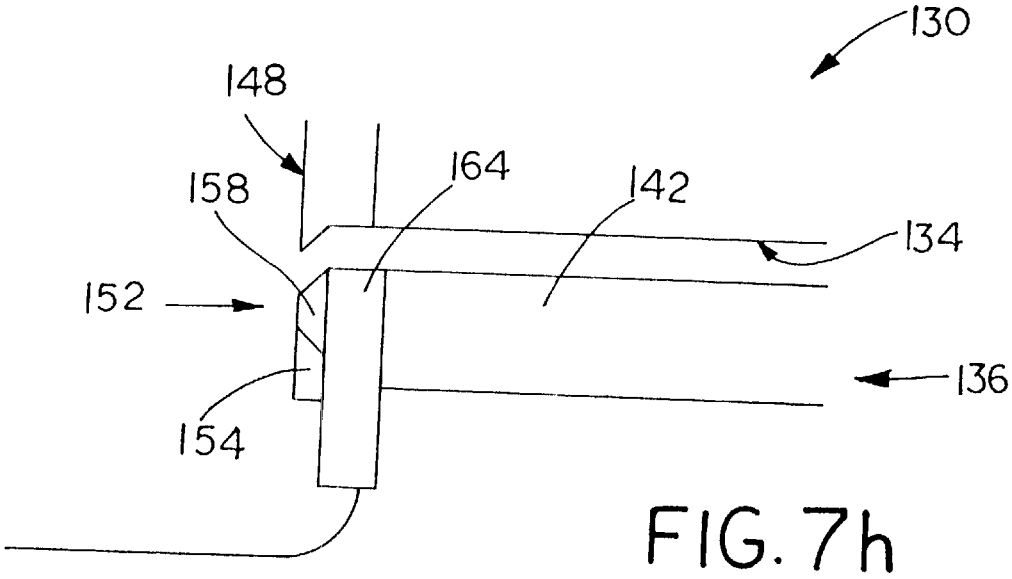

In the variation shown in FIG. 7*h*, gasket 152 has a wide gasket extension 164, gasket extension 164 being made of shim rubber. Gasket extension 164 is bonded to cap end 146 and no bracket fastener 156 is used, thus cantilevering gasket 152 from cap end 146 and thereby allowing gasket 152 to float relative to bevel plate 148. High loading will cause the shim rubber of gasket extension 164 to shear, maintaining bracket member 154 contact with gasket 152 and minimizing bulging in gasket 152.

Figure 7I:
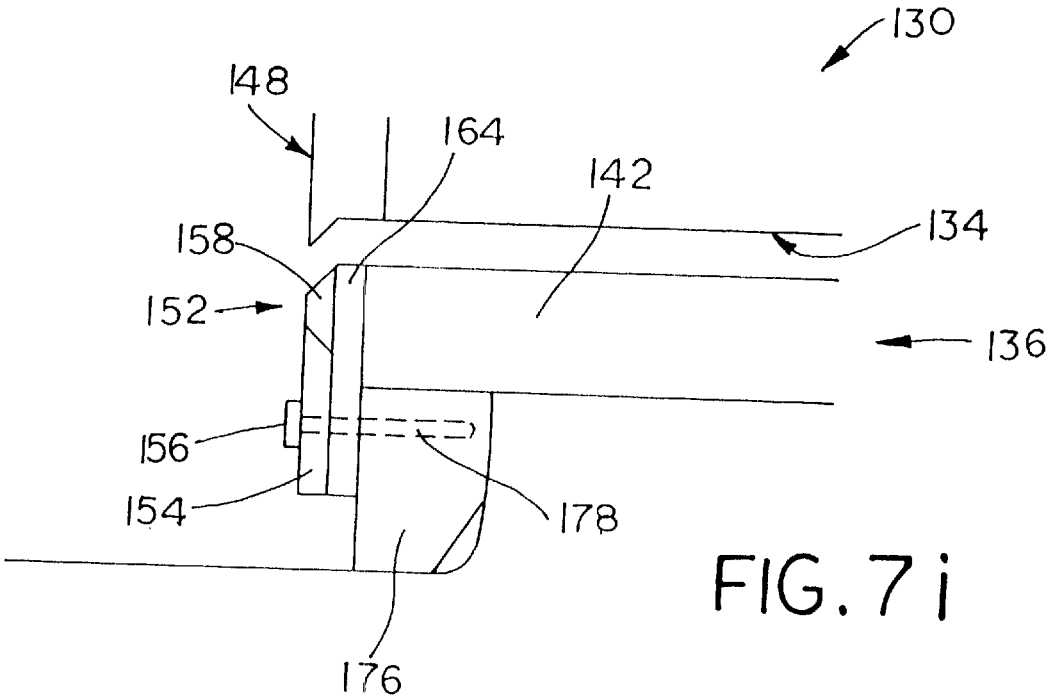

The version illustrated in FIG. 7*i* is similar to the one shown in FIG. 7*d* except that a mounting ring 176 is provided over roll journal 138 and against cap roll core 140. Mounting ring 176 can advantageously be heat shrunk onto roll journal 138, eliminating the need for drilling holes in cap roll 136, holes which could otherwise act as stress concentration sites in cap roll 136. By using mounting ring 176, each mounting hole 178 for corresponding bracket fastener 156 can be pre-drilled therein prior to final positioning of mounting ring 176. Avoiding the need to drill holes in cap roll 136 is highly beneficial, since the length and proximity of roll journal 138 combine to make drilling therein difficult, requiring extremely long drill bits to achieve such drilling.

In the variation shown in FIG. 7*j*, main gasket portion 158 is configured to accommodate rubber deflection thereof upon sealing of gasket assembly 132 against bevel plate 148. This accommodation is achieved by choosing the angles of first angled plate surface 150 and first angled gasket surface 160 to diverge such that a plate-gasket gap 180 at least initially exists between most of first angled plate surface 150 and first angled gasket surface 160 and by choosing the angles of second angled gasket surface 162 and angled bracket surface 164 to diverge such that a bracket-gasket gap 182 at least initially exists between most of second angled gasket surface 162 and angled bracket surface 164. Additionally, opposite cap roll 136, main gasket portion 158 has an outer gasket face 184 and bracket member 154 has an outer bracket face 186. Likewise, opposite main roll 134, bevel plate 148 has an outer plate face 188. To accommodate further deflection in main gasket portion 158, outer gasket face 184 is arranged relative to outer bracket face 186 and outer plate face 188 such that a face gap 190 exists between outer gasket face 184 and a face plane 192 (shown in phantom) extending between outer bracket face 186 and outer plate face 188. During press operation, under nip pressure, main gasket member 158 bulges, which tends to close gaps 180, 182 and 190.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An air press for processing a web, said air press comprising:

a plurality of rolls including at least a first roll and a second roll, said first roll and said second roll being positioned adjacent one another and forming a first nip therebetween, said first roll and said second roll each having a roll end, said roll end of said first roll adjoining said roll end of said second roll;

a bevel plate attached to said roll end of said first roll, said bevel plate having at least a first angled plate face; and a seal ring positioned adjacent said roll end of said second roll, said seal ring being juxtaposed to said bevel plate, said seal ring having at least a first angled ring face, said first angled ring face mating with said first angled plate face.

2. The air press of claim 1, wherein said bevel plate and said seal ring each are made of a material that has at least one of a high hardness and a low coefficient of friction.

3. The air press of claim 1, wherein said plurality of rolls define an air chamber therebetween, said air chamber having a chamber pressure therein, said air press further comprising a first air cylinder piston, said first air cylinder piston being operatively positioned against said seal ring opposite said air chamber.

4. The air press of claim 3, wherein said first air cylinder piston is configured for applying a smallest possible load needed to maintain a seal between said bevel plate and said juxtaposed seal ring.

5. The air press of claim 4, wherein said first air cylinder piston is configured for adapting to changes in the chamber pressure.

6. The air press of claim 3, wherein said first air cylinder is configured to adapt to changes in the chamber pressure.

7. The air press of claim 1, wherein said first roll is a main roll and said second roll is a cap roll.

8. The air press of claim 7, wherein said cap roll is comprised of a cap roll core and a roll cover on said cap roll core.

9. The air press of claim 8, wherein said roll cover has a surface that has at least one of a high modulus of elasticity and a low coefficient of friction.

10. The air press of claim 1, wherein said bevel plate and said seal ring are conjunctively configured to promote at least one of sealing at said adjoining roll ends and alignment thereof.

11. The air press of claim 1, wherein said bevel plate further includes a second angled plate face, said second angled plate face intersecting said first angled plate face to form a plate key slot, said seal ring further including a second angled ring face intersecting said first angled ring face to form a ring key extension, said ring key extension matingly fitting in said plate key slot.

12. The air press of claim 11, wherein said second roll is comprised of a roll core and a roll cover on said roll core, said roll cover having a beveled cover edge at said roll end of said second roll, said seal ring further including a beveled lip extending toward a corresponding beveled cover edge, said beveled lip having at least a first portion thereof sealingly forced into said corresponding beveled cover edge to form a ring-to-cover joint therebetween.

13. The air press of claim 12, wherein said beveled cover edge and said corresponding beveled lip are conjunctively configured for causing a second portion of said beveled cover edge to remain separated from said corresponding beveled lip at a radial position away from said first nip.

14. The air press of claim 12, wherein said roll cover is a soft embossing roll cover.

15. The air press of claim 12, further comprising an impermeable membrane sealingly extending across said ring-to-cover joint and attached to at least one of said beveled lip and said roll cover.

16. The air press of claim 15, wherein said roll end of said first roll includes an end layer of soft rubber, said end layer being contacted by said bevel plate, said end layer being juxtaposed to said impermeable membrane, said end layer and said juxtaposed impermeable membrane together forming a membrane edge seal.

17. The air press of claim 1, wherein said second roll further includes a roll journal, said roll journal extending from said roll end of said second roll, said air press further comprising a pneumatic expansion tubes positioned between said roll journal and said seal ring associated with said roll end of said second roll, said pneumatic expansion tube being configured for holding said seal ring against said bevel plate juxtaposed thereto.

18. The air press of claim 17, wherein said pneumatic expansion tube has a pneumatic pressure therein, said air press further comprising a control system configured for maintaining the pneumatic pressure in said pneumatic expansion tube at a level which results in a minimum force necessary to seal said seal ring against said bevel plate juxtaposed thereto.

19. The air press of claim 17, wherein said plurality of rolls define an air chamber therebetween, said air chamber having a chamber pressure therein, said seal ring including a one-way valve therein, said one-way valve permitting fluid communication from said air chamber to said pneumatic tube, said pneumatic tube being configured to leak air at a predetermined rate.

20. The air press of claim 19, wherein said pneumatic expansion tube has a pneumatic pressure therein, said one-way valve being configured to open only if the chamber pressure exceeds the pneumatic pressure.

21. The air press of claim 17, further comprising a first spring positioned adjacent to said pneumatic tube and attached to at least one of said roll journal and said seal ring, said first spring element being configured for at least one of forcing said one cap seal ring toward said cap roll end corresponding thereto and biasing said one cap seal ring toward said bevel plate juxtaposed thereto.

22. The air press of claim 17, further comprising:

a tube support block mounted on said roll journal, said pneumatic expansion tube being positioned on said tube support block;

a first mounting block positioned adjacent to said roll journal and said tube support block, said first mounting block being directly attached to said tube support block;

a second mounting block mounted directly to said seal ring corresponding to said pneumatic expansion tube, said second mounting block being substantially aligned with said first mounting block; and a first spring element attached to each of said first mounting block and said second mounting block, said first spring element thereby being located adjacent said pneumatic expansion tube.

23. The air press of claim 21, wherein said first spring element is configured for at least one of forcing said seal ring toward said roll end of said second roll corresponding thereto and biasing said seal ring toward said bevel plate juxtaposed thereto.

24. The air press of claim 22, wherein said first spring element, said first mounting block and said second mounting block are conjunctively configured for both supporting said seal ring on said roll journal and permitting movement of said seal ring.

25. The air press of claim 22, wherein said first spring element has a spider web design, an overall deflection per unit length of said first spring element thereby being low.

26. The air press of claim 25, wherein said first spring element includes an inner ring and an outer ring, said inner ring being attached to said first mounting block, said outer ring being attached to said second mounting block.

27. The air press of claim 22, wherein said first spring element is comprised of a thin ribbon, said thin ribbon having a flat ribbon surface, said second roll having a roll radius and a longitudinal roll axis, said roll radius and said longitudinal cap roll axis thereby defining a roll radial direction and a roll axial direction, respectively, said flat ribbon surface being substantially parallel to said roll axial direction, said first spring element having a spring constant that is higher in said roll axial direction than in said roll radial direction.

28. The air press of claim 21, wherein each bevel plate further includes a second angled plate face, said second angled plate face intersecting said first angled plate face to form a plate key slot, each cap seal ring further including a second angled ring face intersecting said first angled ring face to form a ring key extension, said ring key extension matingly fitting in said plate key slot.

29. An air press for pressing a web, said air press comprising:

a plurality of rolls including at least a first roll and a second roll, said first roll and said second roll being positioned adjacent one another and forming a first nip therebetween, said first roll and said second roll each having a roll end, said roll end of said first roll adjoining said roll end of said second roll;

a bevel plate attached to said roll end of said first roll, said bevel plate having at least a first angled plate face; and a replaceable wear assembly including a gasket, said gasket being attached to said roll end of said second roll, said gasket having a first beveled gasket edge, said first beveled gasket edge mating with said first angled plate face.

30. The air press of claim 29, wherein said replaceable wear assembly further includes a bracket member and a bracket fastener, said bracket member having a beveled bracket face, said gasket having a second gasket beveled edge, said beveled bracket face mating with said second beveled gasket edge, said beveled bracket face thereby being configured for biasing said gasket toward both said roll end of said second roll and said juxtaposed bevel plate, said bracket fastener attaching said bracket member to said roll end of said second roll.

31. The air press of claim 30, wherein said gasket is bonded to at least one of said roll end of said second roll and said bracket member.

32. The air press of claim 29, wherein said gasket includes a first gasket portion and a second gasket portion, said first gasket portion including said first beveled gasket edge and said second gasket beveled edge, said second gasket portion being located between said first gasket portion and said roll end of said second roll, said second gasket portion being attached to said roll end of said second roll, said second gasket portion further including a secondary bevel plate engagement face, said secondary bevel plate engagement face configured for sealingly engaging said bevel plate.

33. The air press of claim 30, wherein said gasket includes a first gasket portion and a second gasket portion, said first gasket portion including said first beveled gasket edge and said second gasket beveled edge, said second gasket portion being located between said first gasket portion and said roll end of said second roll, said second gasket portion being attached to said roll end of said second roll, said second gasket portion extending a distance beyond said second gasket beveled edge between said bracket member and said roll end of said second roll.

34. The air press of claim 33, wherein said second roll includes a roll core and a roll cover, said second gasket portion substantially coinciding with said roll cover.

35. The air press of claim 33, wherein said bracket member has a bracket length, said bracket member having a distal member edge opposite said beveled bracket face relative to said bracket length, said second gasket portion extending substantially to said distal member edge, said bracket fastener extending through said bracket member and said second gasket portion and into said roll end of said second roll.

36. The air press of claim 35, wherein said second roll further includes a roll journal, said roll end of said second roll being comprised of a mounting ring mounted against said second roll and around said roll journal, said mounting ring being heat shrunk around said roll journal.

37. The air press of claim 29, said air press-further comprising a shim gasket positioned between said gasket of said replaceable wear assembly and said roll end of said second roll.

38. The air press of claim 37, wherein each bevel plate and one said main roll end form a plate-to-roll joint therebetween, said shim gasket is of sufficient width so as to be configured for contacting said plate-to-roll joint.

39. The air press of claim 37, wherein said shim gasket is bonded to at least one of said roll end of said second roll and said gasket of said replaceable wear assembly.

40. The air press of claim 29, wherein said first beveled gasket edge diverges from said first angled plate face enough to allow for gasket material deflection during mating therebetween.

41. The air press of claim 30, wherein said second beveled gasket edge diverges from said beveled bracket face sufficiently to allow for gasket material deflection during mating therebetween.

42. The air press of claim 30, wherein said one bevel plate has an outer plate surface opposite said first roll and said bracket member has an outer bracket surface opposite said second roll, said gasket of said replaceable wear assembly being inlayed from at least one of said outer plate surface and said outer bracket surface sufficiently to help take up bulging of said gasket of said replaceable wear assembly.

43. The air press of claim 29, wherein said gasket of said replaceable wear assembly has a second-roll facing side, said second-roll facing side having at least one groove therein.

44. A machine for processing a web, said machine comprising:

a plurality of conveyor rolls for carrying the web; and an air press for pressing the web, said air press comprising:

a plurality of rolls including at least a first roll and a second roll, said first roll and said second roll being positioned adjacent one another and forming a first nip therebetween, said first roll and said second roll each having a roll end, said roll end of said first roll adjoining said roll end of said second roll;

a bevel plate attached to said roll end of said first roll, said bevel plate having at least a first angled plate face; and a seal ring positioned adjacent said roll end of said second roll, said seal ring being juxtaposed to said bevel plate, said seal ring having at least a first angled ring face, said first angled ring face mating with said first angled plate face.

45. A machine for processing a web, said machine comprising:

a plurality of conveyor rolls for carrying the web; and an air press for pressing the web, said air press comprising:

a plurality of rolls including at least a first roll and a second roll, said first roll and said second roll being positioned adjacent one another and forming a first nip therebetween, said first roll and said second roll each having a roll end, said roll end of said first roll adjoining said roll end of said second roll;

a bevel plate attached to said roll end of said first roll, said bevel plate having at least a first angled plate face; and a replaceable wear assembly including a gasket, said gasket being attached to said roll end of said second roll, said gasket having a first beveled gasket edge, said first beveled gasket edge mating with said first angled plate face.

* * * * *